US008127816B2

(12) United States Patent
Gnan

(10) Patent No.: US 8,127,816 B2
(45) Date of Patent: Mar. 6, 2012

(54) MACHINE FOR PRODUCING A CORRUGATED CARDBOARD WEB LINED AT LEAST ON ONE SIDE

(75) Inventor: Alfons Gnan, Vilseck (DE)

(73) Assignee: BHS Corrugated Maschinen-und Anlagenbau GmbH, Weiherhammer (DE)

( * ) Notice: Subject to any disclaimer, the term of this patent is extended or adjusted under 35 U.S.C. 154(b) by 337 days.

(21) Appl. No.: 11/865,605

(22) Filed: Oct. 1, 2007

(65) Prior Publication Data

US 2008/0073033 A1 Mar. 27, 2008

(51) Int. Cl.
*B31F 1/28* (2006.01)

(52) U.S. Cl. ..... 156/473

(58) Field of Classification Search ..... 492/47, 492/1, 2, 6, 7, 21, 27; 198/842, 843
See application file for complete search history.

(56) References Cited

U.S. PATENT DOCUMENTS

| | | | | | |
|---|---|---|---|---|---|
| 3,161,125 | A | * | 12/1964 | Hornbostel | 100/155 R |
| 4,305,191 | A | * | 12/1981 | Enomoto | 492/7 |
| 4,856,159 | A | | 8/1989 | Skytta | |
| 5,344,520 | A | * | 9/1994 | Seki et al. | 156/472 |
| 5,632,850 | A | | 5/1997 | Knorr et al. | |
| 5,913,266 | A | * | 6/1999 | Nakaya et al. | 101/375 |
| 5,960,936 | A | * | 10/1999 | Kuehnle et al. | 198/807 |
| 2007/0023147 | A1 | | 2/2007 | Neumann | |

FOREIGN PATENT DOCUMENTS

DE 3625802 A1 2/1988

* cited by examiner

*Primary Examiner* — John L. Goff
*Assistant Examiner* — Barbara J. Musser
(74) *Attorney, Agent, or Firm* — Browdy and Neimark, PLLC

(57) ABSTRACT

A machine for producing a corrugated cardboard web lined at least on one side has a pressing device, which has a tension roller for guiding a pressing belt. The tension roller is formed from a core and an outer jacket surrounding the said core. The core and the outer jacket are connected to one another only in the region of their longitudinal center and are respectively separated from one another towards their outer ends by an annular space.

7 Claims, 3 Drawing Sheets

MACHINE FOR PRODUCING A CORRUGATED CARDBOARD WEB LINED AT LEAST ON ONE SIDE

BACKGROUND OF THE INVENTION

1. Field of the Invention

The invention relates to a machine for producing a corrugated cardboard web lined at least on one side, comprising two fluted rollers for producing corrugations in a paper web, a glue application device for applying glue to tips of the corrugations of the corrugated paper web, and a pressing device for pressing a lined web against the tips provided with glue of the corrugated paper web which lies against one of the fluted rollers over a pressing region, wherein the pressing device has an endless pressing belt, which is guided over a deflection roller and a cylindrical tension roller and which is pressed against the fluted roller over the pressing region.

2. Background Art

In a machine of this type, which is known from EP 06 015 198.2 (corresponding to U.S. Ser. No. 11/459,744), the pressing device has a generally woven, screen-like pressing belt. If the tension roller is constructed in the conventional way so as to be cylindrical and intrinsically completely rigid, a slight stretch in the central region of the pressing belt occurs after only a relatively short operating time, and certainly before wear of the pressing belt usually occurs. This leads to a reduction in the contact pressure of the pressing belt on the central region of the corrugated cardboard to be produced. As a result, the adhesive bonds between the lined web and the corrugated paper web may be insufficient, which leads to corresponding defects in the quality of the corrugated cardboard web. The tension rollers have previously been configured so as to be crowned, meaning they decrease in diameter slightly from the centre of the roller to their axial outer ends. However this did not result in the desired improvement in quality.

SUMMARY OF THE INVENTION

The object of the invention is therefore to configure a generic machine such that the tension in the pressing belt is maintained over the entire width thereof during operation.

According to the invention, the object is achieved by the tension roller being formed from a core and an outer jacket surrounding the said core, the outer jacket and the core having a common longitudinal center and outer ends, and wherein the core and the outer jacket are connected only in the region of their longitudinal center and are respectively separated from one another towards their outer ends by an annular space. By means of the measures according to the invention, the outer jacket of the tension roller can be slightly radially deflected towards the outer ends thereof in the direction of the axis by the tensile stress of the pressing belt during operation. This does not lead, however, to varying circumferential velocities on the surface of the tension roller over its entire axial length, as the circumference of the tension roller remains the same over the length of the tension roller, even when being deflected, in contrast to the crowned configuration. This means that the tension exerted on the pressing belt is constant over the width of the pressing belt, so even relatively intensive stretching of the pressing belt does not occur in its central region in comparison with the outer side regions. Therefore there is no increased wear in the centre of the pressing belt. The quality of the corrugated cardboard web is thus constant over the entire width of the pressing belt for its entire extended service life.

Further features, advantages and details of the invention will become apparent from the following description of an embodiment given with reference to the drawings.

DESCRIPTION OF THE PREFERRED EMBODIMENT

Figure 1:
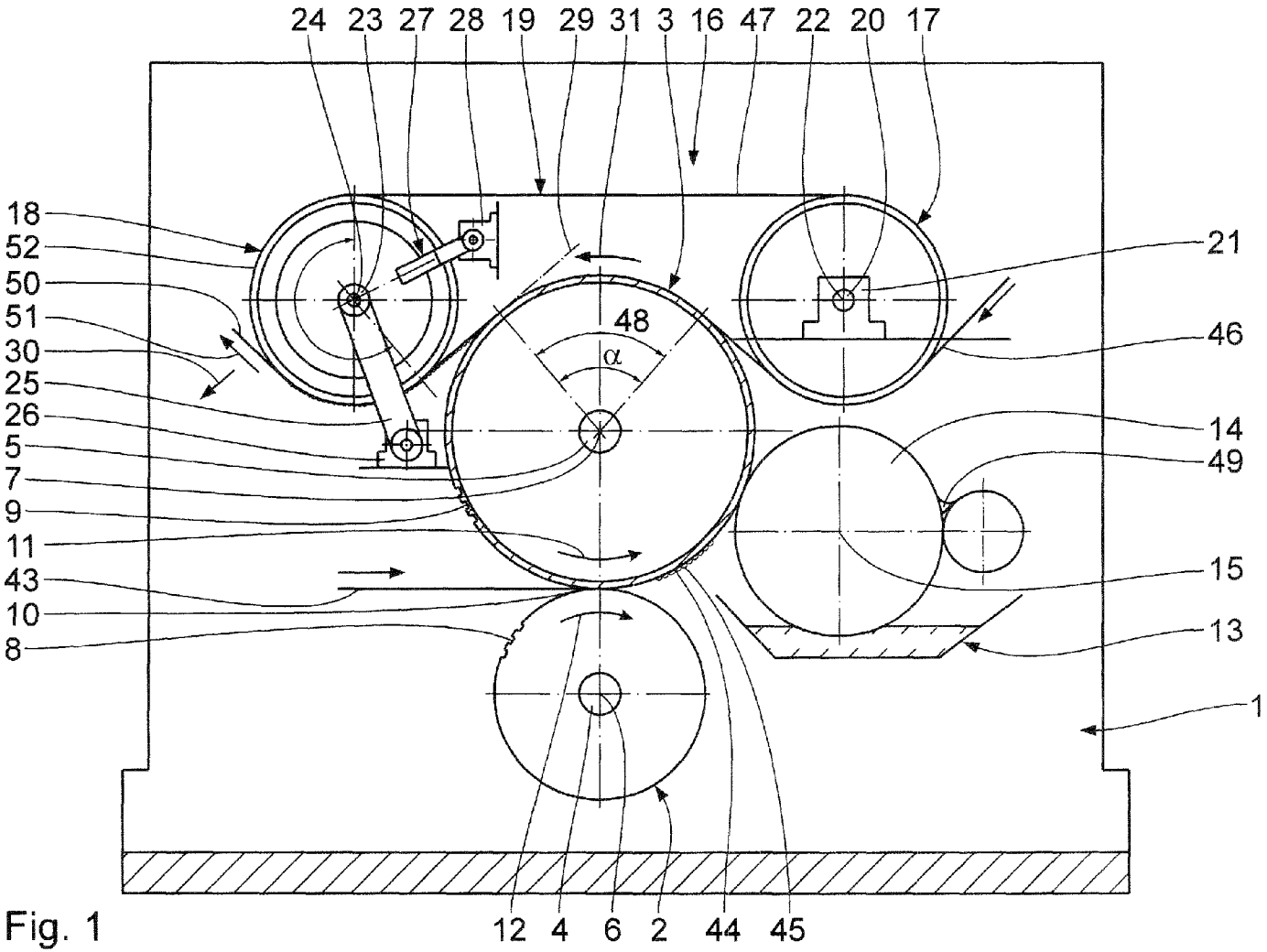
FIG. 1 shows a side view of a machine for producing a corrugated cardboard web lined on one side.
Figure 2:
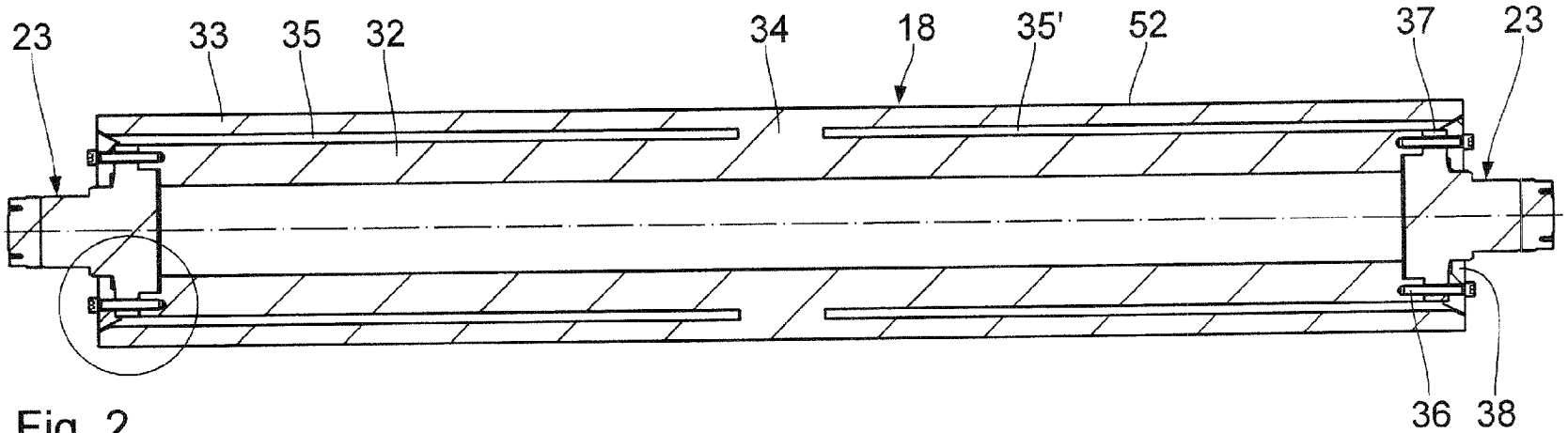
FIG. 2 shows a longitudinal section through a tension roller of the machine according to FIG. 1.
Figure 3:
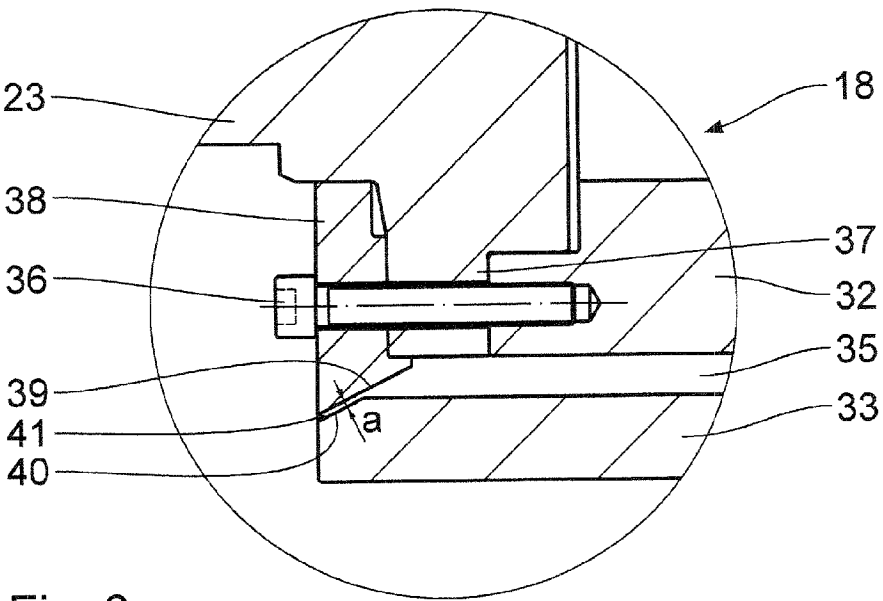
FIG. 3 shows an enlarged partial detail of FIG. 2.
Figure 4:
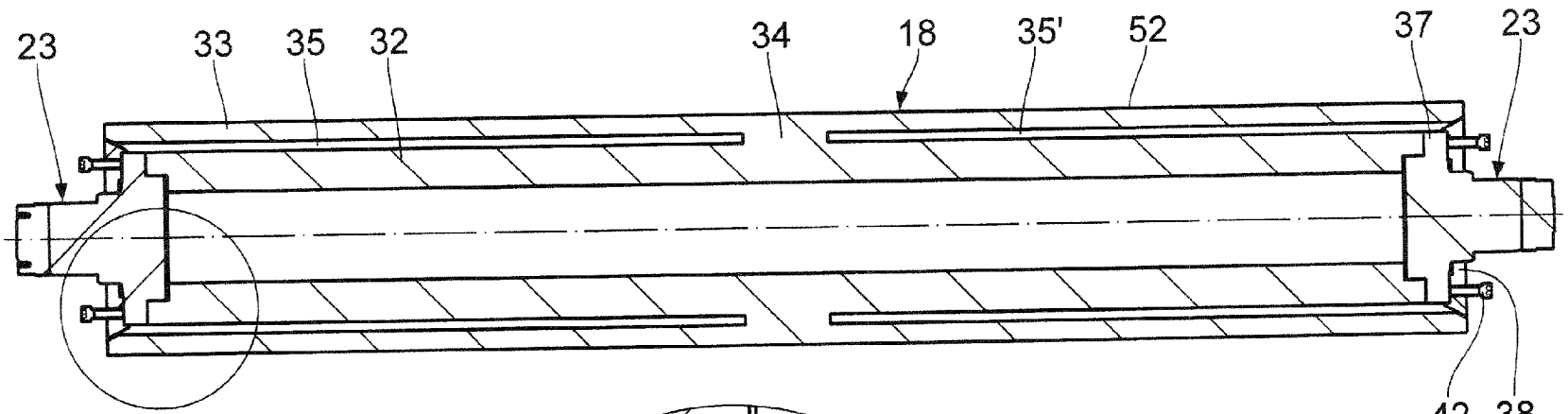
FIG. 4 shows a longitudinal section through a tension roller of the machine according to FIG. 1 partially rotated about the longitudinal axis in comparison to FIG. 1
Figure 5:
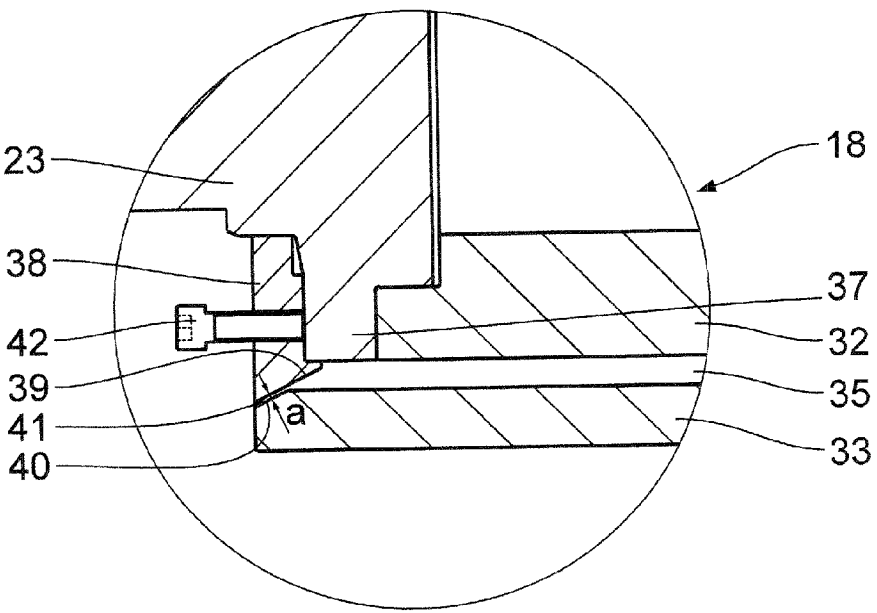
FIG. 5 shows an enlarged partial detail of FIG. 2.

A lower fluted roller 2 and an upper fluted roller 3 are mounted in a machine frame 1 so as to be able to rotate by means of shafts 4, 5 and have axes 6, 7 parallel relative to one another. On their cylindrical surfaces they are provided with flutes 8, 9 which extend parallel to the axes 6, 7 and which mesh in the contact region 10 of the two fluted rollers 2, 3. One of the fluted rollers 2, 3, usually the upper fluted roller 3, is driven in the direction of rotation 11, while the other fluted roller, usually therefore the lower fluted roller 2, is entrained by the other fluted roller 3 in the direction of rotation 12. A glue application device 13 is arranged in the machine frame 1 downstream of the contact region 10 in the direction of rotation 11 or 12, said glue application device having a glue application roller 14 which can be fed towards the flutes 9 of the upper fluted roller 3. The application roller 14 is rotatable about an axis 15.

In the upper region of the upper fluted roller 3 a pressing device 16 is provided, which has a cylindrical deflection roller 17 which is intrinsically resistant to bending, a tension roller 18 and a pressing belt 19. The deflection roller 17 is mounted on bearings 21 of the machine frame 1 by means of bearing journals 20 so as to be freely rotatable about an axis 22, i.e. it is not driven. The tension roller 18 is mounted by means of bearing journals 23 about its axis 24 on bearing levers 25, which in turn are pivotally mounted in bearings 26 attached to machine frame 1. A tensioning drive 27 which acts on the bearing levers 25 in the region of the bearing journals 23 is a piston cylinder drive which can be hydraulically operated. This tensioning drive 27 is in turn pivotally mounted in a support 28, which is attached to the machine frame 1. Tensioning the pressing belt 19 is thus achieved by pivoting the tension roller 18 so that it is substantially parallel to the run-off tangent 29 in the direction 30. All the axes 6, 7, 15, 22, 24 extend parallel to one another. Tensioning the pressing belt 19 is achieved by pivoting the tension roller 18 so that it is substantially parallel to the run-off tangent 29 in the direction 30.

As may be seen from FIG. 1, the pressing belt 19 rests against the flutes 9 of the upper fluted roller 3 over an angle of wrap $\alpha$ of approximately 90° and revolves in the same direction of rotation as the said fluted roller corresponding to directional arrow 31. The pressing belt 19 runs off the upper fluted roller 3 along the run-off tangent 29, which is identical to the run-on tangent of the pressing belt 19 onto the tension roller 18.

The pressing belt 19 is configured as a fine-mesh, tension-proof screen belt, as is known, for example, from DE 10 2005 035 030 A.

As shown in FIG. 2 to 5, the tension roller is configured so as to be hollow. It has a tubular core 32 and a similarly cylindrical outer jacket 33. The outer jacket 33 and the core 32 are configured so as to be integral and are connected to one another by a ring land 34 only in their longitudinal centre. An annular space 35 and 35' which is, for example, recessed is formed on either side of this ring land 34. The bearing journals 23 are fastened on the end faces of the core 32 by means of screws 36. The outer jacket 33 is therefore connected to the core 32 and thus to the bearing journals 23 in its centre only by the ring land 34.

As may also be seen from FIG. 2 to 5, in the axial outer region, i.e. on each axially externally disposed side of the flange 37 of the bearing journals 23, an adjusting ring 38 is arranged, which has on its outer side a support surface 39 which acts as a support and extends conically outwards. On the associated inner side of the outer jacket 33, this support surface 39 is associated with a contact surface 40 which also extends conically outwards. Between the support surface 39 and the contact surface 40 a gap 41 having a very small width a of, for example, from 0.3 to 1.0 mm is configured. As a result the adjusting ring 38 forms a support for deflection of the outer jacket 33 relative to the core 32. If the deflection in the axial outer regions reaches the width of the gap 41, the outer jacket 33 abuts the adjusting ring 38, thereby delimiting the deflection. The adjusting ring 38 has adjusting screws 42 (shown in FIGS. 4 and 5), via which the ring is supported against the respective flange 37 of the bearing journal 23. By adjusting a corresponding spacing between the adjusting ring 38 and the flange 37 the support surface 39 can be displaced in the direction of axis 24, allowing the radial width a of the gap 41 to be varied. Since the screws 36 also penetrate the adjusting ring 38, the respective adjusting ring 38 is also rigidly connected in an axial direction to the core 38 and the jacket 33 and the bearing journals 23.

The mode of operation of the machine is as follows:

A paper web 43 passes into the contact region 10 between the upper and lower fluted rollers 2, 3 and is provided with corrugations 44 by means of flutes 8, 9. The tips 45 of the respective corrugations 44 are provided with glue in the glue application device 13. The other regions of the corrugated paper web 43 are not glued. A lined web 46, which is also made of paper and has the same width as the paper web 43, is supplied via the deflection roller 17. This lined web 46 is introduced on the outer side 47 of the pressing belt 19 and is pressed into the pressing region 48, which is defined by the angle of wrap $\alpha$, of the pressing belt 19, against the tips 45 of the corrugated paper web 43 located in the flutes 9 of the upper fluted roller 3 and is connected to the said paper web. In so doing, the outer side 47 of the pressing belt 19 presses the lined web 46 against the corrugated paper web 43.

Since the upper fluted roller 3 is heated in the conventional manner to approximately 170° C., the water held in the glue 49 located at the tips 45 of the corrugations 44 evaporates and escapes at least partly through the lined web 46 and the screen-like pressing belt 19.

The fully-glued corrugated cardboard web 50 lined at least on one side with a lined web 46 runs off the upper fluted roller 3 in the direction of the run-off tangent 29 with the pressing belt 19 and is guided with the pressing belt 19 partly around the tension roller 18. From this point it is supplied to a winding device in draw-off direction 51.

The configuration of the tension roller 18 ensures that, during operation, the outer jacket 33 is deflected towards the axis 24 as a result of the high tension in the pressing belt 19, in the respective region 52 in which the pressing belt 19 rests against the tension roller 18. In contrast to a crowned roller, however, the circumference of the outer jacket 33 remains constant over its entire length as it is inherently cylindrical. This in turn means that it has, in contrast to a crowned roller, identical circumferential velocities over its entire axial length. The pressing belt 19 is thus subjected to constant tensile stress over its entire width so that it does not, as is otherwise the case in practice, lose strength in the centre resulting in a reduction of the contact force or the contact pressure on the corrugated cardboard in the pressing region 48, with the result that the adhesive bonds between the lined web 46 and the tips 45 of the corrugations 44 of the paper web 43 open up again in the central region. The deflection of the outer jacket 33 can be delimited by the support formed by the respective adjusting ring 38; the deflection can thus be adjusted and delimited by suitable selection or adjustment of the adjusting ring 38.

What is claimed is:

1. Machine for producing a corrugated cardboard web (50) lined at least on one side, comprising:

two fluted rollers (2, 3) for producing corrugations (44) in a paper web (43), a glue application device (13) for applying glue (49) to tips (45) of the corrugations (44) of the corrugated paper web (43), and a pressing device (16) for pressing a lined web (46) against the tips (45) provided with glue (49) of the corrugated paper web (43) which lies against one of the fluted rollers (3) over a pressing region (48), wherein the pressing device (16) has an endless pressing belt (19), which is guided over a deflection roller (17) and a cylindrical tension roller (18) and which is pressed against the fluted roller (3) over the pressing region (48), and wherein the tension roller (18) has two axial ends and includes a core (32) and an outer jacket (33) surrounding said core, the outer jacket (33) and the core (32) having a common longitudinal center and extending to the axial ends of said tension roller, and wherein the core (32) and the outer jacket (33) are connected only in the region of their longitudinal center and are separated from one another towards their axial ends by respective annular spaces (35, 35'), and wherein said machine further comprises a respective support (38) in the annular space at each of the axial ends of said tension roller, to delimit a gap (41) between the support (38) and the outer jacket (33) at each of the axial ends of said tension roller, and wherein each support comprises an adjusting ring (38) configured to limit a deflection of the outer jacket (33) toward the core (32), and a holding element maintaining said ring in a fixed axial position with respect to the core while said machine is in operation, and wherein at each of the axial ends of said tension roller, the adjusting ring (38) has a conical outer surface facing the outer jacket, the outer jacket has a conical inner surface facing said conical outer surface, and the gap (41) is formed between the conical outer and inner surfaces, and wherein each of the conical outer and inner surfaces extends conically outwardly toward the respective axial end, and wherein the gap is annular when the outer jacket is in an undeflected state so that the support is separated from the outer jacket by an annular space.

2. Machine according to claim 1, wherein the core (32) and the outer jacket (33) are connected to one another by a ring land (34).

3. Machine according to claim 2, wherein the core (32), the outer jacket (33) and the ring land (34) are configured so as to be integral with one another.

4. Machine according to claim 1, wherein the annular spaces (35, 35') are configured so as to be annular cylindrical in regions spaced axially inwardly from said supports.

5. Machine according to claim 1, wherein the gap has a constant width when no pressure is exerted on the tension roller (18).

6. Machine according to claim 1, wherein each support (38) is a part of the tension roller that is separate from the core and the outer jacket.

7. Machine according to claim 1, wherein the width (a) of the gap (41) is adjustable by adjusting a corresponding axial position of the adjusting ring (38) with respect to the core (32).

* * * * *

UNITED STATES PATENT AND TRADEMARK OFFICE

CERTIFICATE OF CORRECTION

PATENT NO. : 8,127,816 B2
APPLICATION NO. : 11/865605
DATED : March 6, 2012
INVENTOR(S) : Alfons Gnan It is certified that error appears in the above-identified patent and that said Letters Patent is hereby corrected as shown below:

On the title page, after the following section:

"(22) Filed: October 1, 2007"

Add the following section entitled:

--(30) Foreign Application Priority Data--

On the title page, after item (30), add the following priority data:

--September 29, 2006 (DE) ..... 102006046500.8--

Signed and Sealed this
Twenty-eighth Day of May, 2013

Teresa Stanek Rea
*Acting Director of the United States Patent and Trademark Office*